United States Patent [19]

Frank

[11] 4,291,713

[45] Sep. 29, 1981

[54] DEVICE FOR HEATING THE SEAMS OF WRAPPERS FOR ROD-LIKE FILLERS IN CIGARETTE MAKING MACHINES OR THE LIKE

[75] Inventor: Willi Frank, Hohnsdorf, Fed. Rep. of Germany

[73] Assignee: Hauni-Werke Korber & Co. KG, Hamburg, Fed. Rep. of Germany

[21] Appl. No.: 870,605

[22] Filed: Jan. 18, 1978

[30] Foreign Application Priority Data

Jan. 27, 1977 [DE] Fed. Rep. of Germany ..... 2703288

[51] Int. Cl.[3] ..... A24C 5/24

[52] U.S. Cl. ..... 131/68; 131/69; 156/359

[58] Field of Search ..... 131/58, 60, 61 R, 67, 131/68, 69; 219/243, 388; 156/201, 202, 359, 360, 380; 53/451, 550, 551

[56] References Cited

U.S. PATENT DOCUMENTS 3,619,325 11/1971 Hair et al. ..... 156/359

3,982,380 9/1976 Seragnoli ..... 156/359

FOREIGN PATENT DOCUMENTS 1057482 2/1967 United Kingdom ..... 131/68

*Primary Examiner*—V. Millin

*Attorney, Agent, or Firm*—Peter K. Kontler

[57] ABSTRACT

The seam of the tubular wrapper for the rod-like filler of tobacco or filter material in a cigarette or filter rod making machine is heated by a first heating element during acceleration of the machine from zero speed to normal operating speed. When the machine reaches the normal speed, the seam is additionally heated by a second heating element whose heating action is more pronounced than that of the first heating element. The first heating element is caused to engage the moving seam when the first increment of adhesive film, which is applied to one marginal portion of the wrapper by a paster, reaches the first heating element. The second heating element is moved into engagement with the seam when the RPM of the prime mover for the filler transporting conveyor reaches a preselected value. Both heating elements are disengaged from the seam in response to deactivation of the prime mover with a delay which corresponds to the interval elapsing between deactivation of the prime mover and the transport of last adhesive-coated increment of the one marginal portion to a position of register with the first heating element.

5 Claims, 2 Drawing Figures

DEVICE FOR HEATING THE SEAMS OF WRAPPERS FOR ROD-LIKE FILLERS IN CIGARETTE MAKING MACHINES OR THE LIKE

BACKGROUND OF THE INVENTION

The present invention relates to a device for heating the seams of tubular wrappers which surround rod-like fillers in machines for the production of rod-shaped articles which constitute or form part of smokers' products. More particularly, the invention relates to a device for promoting the setting of adhesive serving to connect the marginal portions of a tubular wrapper which consists of cigarette paper or the like and surrounds a rod-like filler of tobacco and/or filter material.

It is known to start various components of a cigarette making machine (or analogous machine for the production of rod-shaped articles which constitute or form part of smokers' products) at different stages of acceleration of the machine from zero speed to normal operating speed. Such stepwise or stagewise actuation of various components is desirable, especially if the machine forms part of a complete production line, in order to reduce the number of rejects during acceleration from zero speed to normal operating speed. A complete production line may comprise one or more machines for the production of plain cigarettes, one or more machines for the production of filter rod sections, one or more filter cigarette making machines, and one or more packing machines for filter cigarettes. One of the aforementioned components in a machine for the making of plain cigarettes, filter rod sections or filter cigarettes is the heating device which promotes the setting of adhesive that is applied by a suitable paster to bond the overlapping marginal portions of a web of cigarette paper or the like to each other. In a maker of plain cigarettes, the paster applies a film of adhesive to one marginal portion of a continuous cigarette paper web, and such marginal portion is thereupon folded over the other marginal portion so that the web is converted into a continuous tubular wrapper which surrounds a rod-like filler of tobacco particles. In a filter rod maker, the web (which may consist of paper, artificial cork or other suitable wrapping material) is converted into a tube which surrounds a rod-like filler consisting of fibrous filter material and/or other filter material or materials. In a filter cigarette making machine, the web is subdivided into adhesive-coated uniting bands which are used to bond filter rod sections to adjacent end portions of plain cigarettes.

The trend in the tobacco processing industry is toward higher operating speeds of machines which process tobacco and/or filter material. This necessitates a pronounced intensification of heating action in order to insure that the seam of the wrapper which surrounds a continuous rod-like filler of tobacco and/or filter material can resist the tendency of confined material to expand as well as that the seam is not caused to burst open when a wrapped tobacco filler or a wrapped filter material filler is severed to yield a succession of plain cigarettes or filter rod sections. However, pronounced intensification of heating action is likely to result in charring or discoloration of the seam, especially during the initial stage of operation subsequent to starting of the prime mover for a discrete machine, for certain machines of a production line, or for all machines of a production line. Heretofore known proposals to conform the intensity of heating action to changes in the speed of lengthwise movement of a tubular wrapper which surrounds a rod-like filler of tobacco or filter material failed to gain acceptance in the tobacco processing industry, primarily because the inertia of heating devices is too high to permit gradual intensification or gradual weakening of the heating action proportionally with changes in the speed of the filler. Such mode of operating the heating device of a cigarette maker or the like is satisfactory only when the acceleration of the machine to normal operating speed takes up a very long interval of time. This is undesirable because the acceleration stage invariably or almost invariably entails the production of rod-shaped articles which are or are likely to be defective, i.e., it is preferred to accelerate the machine to normal operating speed with a minimum of delay.

OBJECTS AND SUMMARY OF THE INVENTION

An object of the invention is to provide a novel and improved apparatus for heating the seam of a tubular wrapper, which surrounds a rod-like filler of tobacco and/or filter material, in such a way that the adhesive film in the seam is caused to set without charring or discoloration of the wrapping material irrespective of the speed at which the filler is transported in a cigarette maker or the like.

Another object of the invention is to provide a novel and improved apparatus for promoting the setting of adhesive in the seams of tubular wrappers of cigarette rods or the like during acceleration of the prime mover of the maker from zero speed to normal operating speed as well as subsequent to acceleration to normal speed.

A further object of the invention is to provide a novel and improved apparatus for heating the seam of a tubular wrapper consisting of cigarette paper, artificial cork or other wrapping material which is used in machines for the production of rod-shaped articles constituting or forming part of smokers' products.

An additional object of the invention is to provide a novel and improved device which can be incorporated in a cigarette maker, a filter rod maker or an analogous machine to prevent charring and/or discoloration of the seam during acceleration of the prime mover of the machine to normal operating speed as well as subsequent to such acceleration.

Another object of the invention is to provide a machine which embodies the improved heating device and can be designed to accelerate its moving parts to normal operating speed within extremely short intervals of time.

An ancillary object of the invention is to provide a novel and improved heating device adjacent to the garniture of a cigarette making or filter rod making machine.

A further object of the invention is to provide novel and improved adjusting means for the seam heating device of a cigarette maker or the like.

One feature of the invention resides in the provision of a device for promoting the setting of adhesive in the seam which includes the overlapping marginal portions of a tubular wrapper surrounding a rod-like filler of fibrous material (particularly tobacco and/or filter material for tobacco smoke) and wherein the seam extends lengthwise of the filler. The device comprises means for transporting the wrapped filler lengthwise at a plurality of speeds (e.g., such transporting means may include the garniture of a cigarette maker), means for subjecting the adhesive in successive increments of the seam of the moving wrapper to a heating action, and means for adjusting or varying the heating action stepwise as a function of changes in the speed of the wrapped filler.

The transporting means may include means for accelerating the wrapped filler from zero speed to a predetermined speed, and for thereupon advancing the wrapped filler at a second speed which at least equals the predetermined speed. The adjusting or varying means then comprises means for subjecting the adhesive to a heating action of first magnitude or intensity in the course of the accelerating step, and means for subjecting the adhesive to the heating action of first intensity plus a heating action of (preferably more pronounced) second magnitude or intensity when the filler reaches the predetermined speed.

The accelerating and advancing means may include means for operating a rotary filler-transporting prime mover at a plurality of speeds, and the aforementioned varying or adjusting means then further includes means for monitoring the RPM of the prime mover and for initiating the operation of means for subjecting the adhesive to the heating action of first intensity plus the heating action of second intensity when the monitored RPM of the prime mover reaches a preselected value corresponding to predetermined speed of the wrapped filler.

The transporting means further includes means for confining the wrapped filler to movement in a predetermined direction and along a predetermined path in the course of the aforementioned accelerating and advancing steps. The filler is confined to such movement by the aforementioned garniture if the device is embodied in a cigarette maker. The means for subjecting the adhesive to heating action is operative in a first portion of the path, and the device further comprises means for applying adhesive to a first and to the next-following increments of at least one marginal portion of the web which is about to be converted into the tubular wrapper (this takes place in a second portion of the path which second portion is located ahead of the first portion, as considered in the directon of movement of the filler), means for causing the marginal portions to overlap each other in a third portion of the path between the first and second portions, and means for timing the initiation of the step of subjecting the adhesive to heating action of first intensity to coincide with arrival of the first adhesive-coated increment of the one marginal portion into the first portion of the path.

The novel features which are considered as characteristic of the invention are set forth in particular in the appended claims. The improved device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
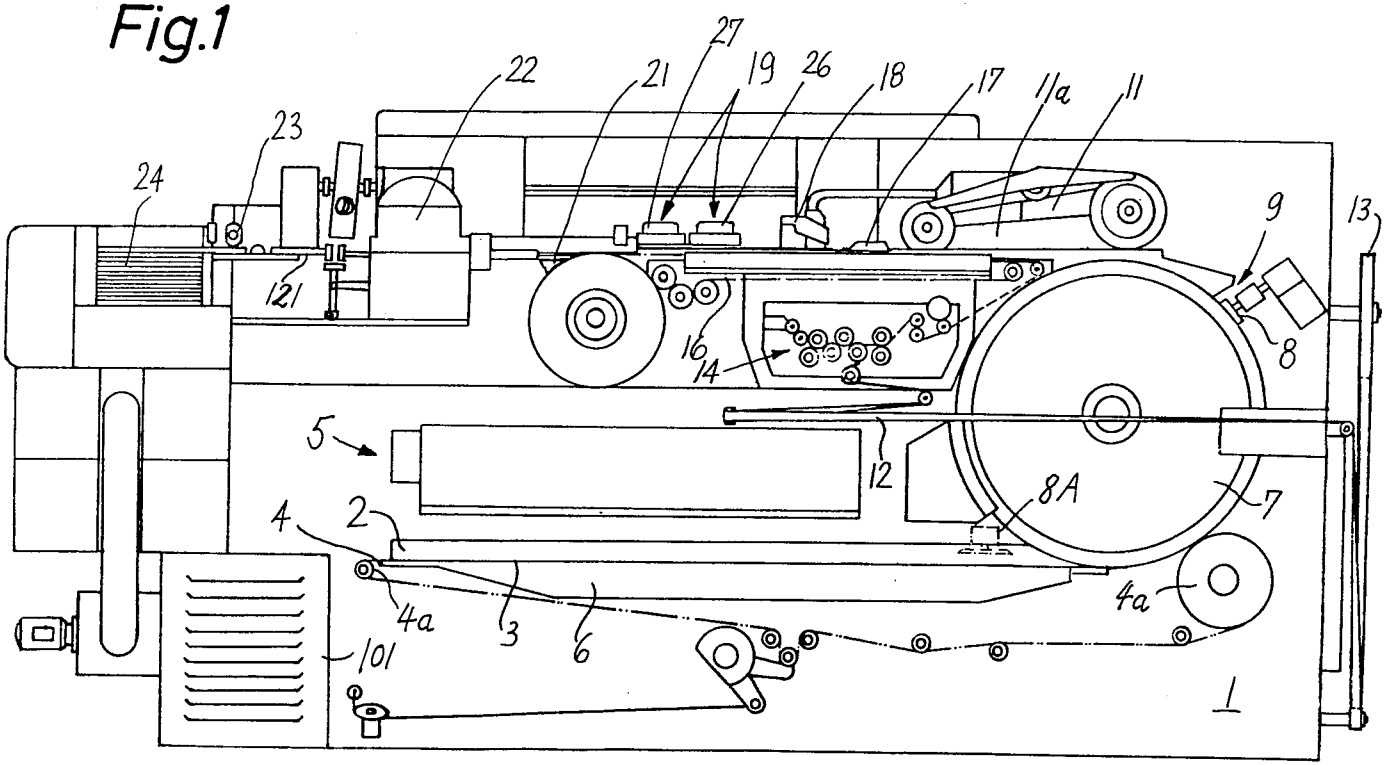
FIG. 1 is a schematic front elevational view of a cigarette making machine which embodies the seam heating device of the present invention.

FIG. 1 shows a cigarette making machine of the type known as "GARANT" (trademark) produced by Hauni-Werke Körber & Co. KG, of Hamburg, Federal Republic Germany. The machine comprises a frame 1 which supports a distributor 5 serving to feed a wide shower of tobacco particles into an elongated narrow tobacco channel 2 having a perforated bottom wall 3 which constitutes the top wall of a suction chamber 6. An endless foraminous belt conveyor 4 is trained over rollers 4*a* and its upper reach travels above the perforated wall 3 so that it intercepts and entrains the descending tobacco particles which thereby form a growing tobacco stream advancing in a direction to the right, as viewed in FIG. 1. The upper side of the fully grown tobacco stream is trimmed by a first equalizing device 8A which is indicated by phantom lines. The once trimmed tobacco stream thereupon enters the circumferential groove of a suction wheel 7 which is driven to rotate in a counterclockwise direction, as viewed in FIG. 1, and surrounds a stationary suction chamber (not specifically shown) which attracts the tobacco stream to the foraminous bottom wall of the circumferential groove. A second equalizing device 8 trims the exposed side of the stream in the groove of the suction wheel 7 (it will be noted that the equalizing devices 8A and 8 trim two sides of the stream which are located opposite each other) and thus converts the stream into a continuous rod-like tobacco filler 9 which is caused to leave the groove at the apex of the suction wheel and is advanced onto the upper reach of an endless transporting conveyor belt 16 known as garniture. The means for transferring the filler 9 onto the garniture 16 comprises an endless foraminous band conveyor 11 whose lower reach travels below the open underside of a stationary suction chamber 11*a*. The garniture 16 confines the filler to movement along a straight path in a direction to the left, as viewed in FIG. 1, and cooperates with a wrapping mechanism 17 which drapes the filler 9 into a continuous web 12 of cigarette paper. The web 12 is drawn off a supply reel 13 and advances through an imprinting mechanism 14 which provides spaced-apart portions of the web with indicia denoting the brand name of plain cigarettes, the name of the manufacturer, the trademark of the manufacturer and/or other information. The wrapping mechanism 17 drapes the web 12 around the filler 9 in such a way that one marginal portion of the web extends tangentially upwardly and is coated with a film of adhesive by a paster 18. The wrapping mechanism 17 thereupon folds the adhesive-coated marginal portion of the web over the other marginal portion so that the two marginal portions form an elongated seam which extends lengthwise of the resulting continuous cigarette rod 21. The seam is heated by a heating device or sealer 19 which promotes the setting of adhesive and thus insures that the tubular wrapper (converted web 12) of the rod 21 can withstand the pressure of compacted material of the confined filler 9. In accordance with a feature of the present invention, the heating unit 19 comprises two plate-like heating or sealing elements 26 and 27 which are located one behind the other, as considered in the direction of movement of the upper reach of the garniture 16, and respectively serve to subject successive increments of the seam to a first (preferably less pronounced) and second (preferably more pronounced) heating action.

The leader of the cigarette rod 21 enters a cutoff 22 which severs the rod at regular intervals so that the latter yields a series of discrete plain cigarettes 121 of unit length or multiple unit length. The plain cigarettes 121 form a single file and advance along a rapidly rotating accelerating cam 23 which propels successive cigarettes or pairs of neighboring cigarettes into successive peripheral flutes of a drum-shaped rotary row forming conveyor 24. The latter converts the single file of cigarettes 121 into one or more rows whose constituents travel sideways and are admitted into a filter cigarette making machine, into the sender of a pneumatic conveyor system, to storage or directly to a packing machine, not shown.

The prime mover (e.g., a variable-speed electric motor or a constant speed motor and a variable-speed transmission) is installed in the frame 1 behind a screen 101. If the cigarette maker of FIG. 1 is directly coupled to a filter cigarette making machine, its moving parts can be driven by the variable-speed prime mover of the filter cigarette making machine.

Figure 2:
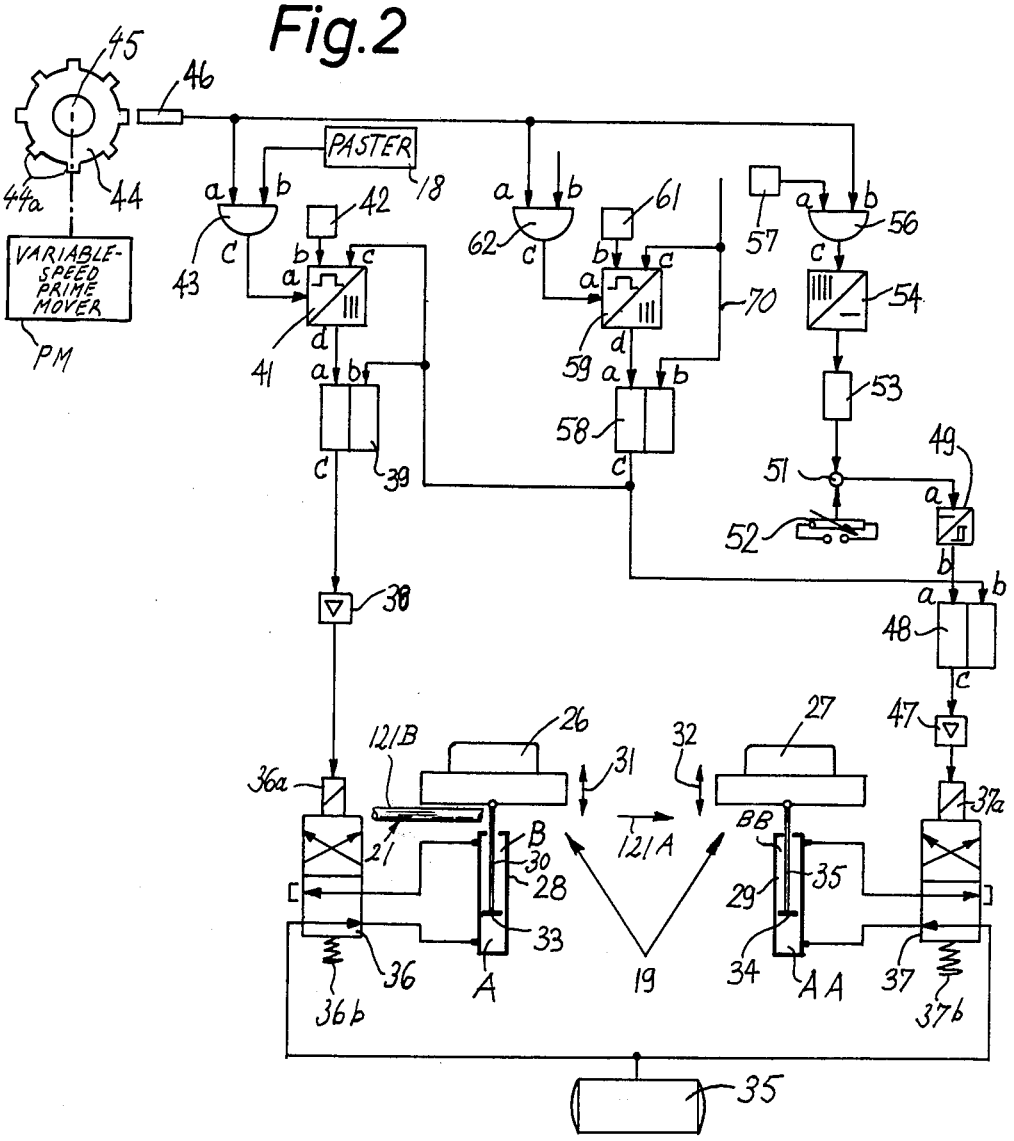
FIG. 2 is a diagrammatic view of the heating device, of moving means for its sealing or heating elements, and of means for operating the moving means.

FIG. 2 illustrates the details of the means for moving the heating elements 26, 27 into and from engagement with the seam 121B of the tubular wrapper of the continuous cigarette rod 21. The first sealing element 26 (hereinafter called plate for short) is movable toward and away from the seam 121B by a fluid-operated motor here shown as a double-acting pneumatic cylinder and piston unit including a cylinder 28, a piston 33 which is reciprocable in and divides the interior of the cylinder 28 into chambers A and B, and a piston rod 30 which is connected to the plate 26. The piston 33 can move the plate 26 in directions indicated by the double-headed arrow 31. The cigarette rod 21 advances in the direction indicated by arrow 121A and the seam 121B of its tubular wrapper is adjacent to the undersides of the plates 26, 27.

The chambers A and B of the cylinder 28 can be connected to a suitable source 35 of compressed gaseous fluid (e.g., air) or to the atmosphere by a solenoid-operated valve 36.

The second sealing element or plate 27 is movable toward and away from engagement with the seam 121B by a second doubleacting pneumatic cylinder and piston unit including a cylinder 29, a piston 34 which divides the interior of the cylinder 29 into chambers AA and BB, and a piston rod 35 which is attached to the plate 27 and is movable in directions indicated by arrow 32. The chambers AA and BB can be connected to the source 35 or to the atmosphere by a second solenoid-operated valve 37. The term "sealing engagement" (between the plate 26 and/or 27 and the seam 121B) is intended to denote movement of these plates to positions in which the plates may but need not necessarily contact the adhesive-coated (outer) marginal portion of the wrapper of the rod 21, as long as the plates are in optimum positions for heating of the adhesive film between the two marginal portions of the wrapper.

The means for operating the motor for the plate 26, i.e., for actuating the valve 36, comprises an amplifier 38 which can energize the solenoid **36*a* of valve 36 in response to transmission of a signal from the output c of a signal storing unit 39. The latter has a setting input a and an erasing input b. The arrangement is such that the output c transmits a signal to the amplifier 38 (to energize the solenoid 36*a* and to move the valving element of the valve 36 from the position which is shown in the drawing) when the input a receives a signal from the output c of an AND-gate 43 by way of a counter 41. The signal at the output c of the storing unit 39 is erased when the latter receives a signal at the input b; such erasing signal is transmitted by the output c of a second signal storing unit 58. The input a of the storing unit 39 receives signals from the output d of the counter 41, the latter having a first input a connected to the output c of the AND-gate 43, a second input b which receives signals from a decoding unit 42, and a third input (resetting input) c which is connected to the output c of the signal storing unit 58. The input b of the AND-gate 43 receives signals from the paster 18, and the input a of this gate receives signals from a proximity switch 46 forming part of a pulse generator further including a wheel 44 having projections 44*a*. When a projection 44*a* moves past the switch 46, the latter transmits a signal to the input a of the AND-gate 43. The wheel 44 is driven by the variable-speed prime mover PM of the cigarette maker (by way of a shaft 45) in synchronism with other moving parts, i.e., its speed varies when the speed of forward movement of the rod 21** changes.

The means for operating the motor for the plate 27, i.e., for energizing the solenoid **37*a* of the valve 37, comprises an amplifier 47 which is connected with the output c of a signal storing unit 48. The latter further comprises an erasing input b and a second or setting input a which is connected to the output b of a threshold switch 49 (e.g., a Schmitt trigger). The input a of the switch 49 is connected to a signal comparing stage 51 which receives reference signals from a suitable source 52 (e.g., an adjustable potentiometer) and from the output of a digital-to-analog converter 54 (by way of resistor means 53). The input of the converter 54 receives signals from the output c of an AND-gate 56. The input a of the gate 56 is connected to a detector 57 which monitors the position of the plate 26, and the input b of this gate is connected to the proximity switch 46 of the pulse generator. The detector 57 transmits a signal when the plate 26 is moved into engagement with the seam 121B. The converter 54 monitors the speed of the prime mover PM and filler 9, and causes the switch 49 to transmit a signal when the speed of the prime mover rises to the normal operating speed (or to another predetermined speed which is denoted by intensity of the reference signal furnished by the potentiometer 52**).

The means for resetting the counter 41 and for transmitting erasing signals to the inputs b of the signal storing units 39 and 48 comprises an AND-gate 62 whose input a is connected to the proximity switch 46, whose input b is connected to the prime mover PM of the cigarette maker (or to any other device which causes the transmission of a signal to the input b when the prime mover PM is brought to a halt) and whose output c is connected with the input a of a second counter 59. The latter has a second input b which is connected to a decoder 61, a resetting input c which receives signals from the prime mover PM, and an output d connected to the setting input a of the aforementioned signal storing unit 58. The unit 58 further comprises an erasing input b. The conductor means 70 which is connected to the input c of the counter 59 and to the erasing input b of the storing unit 58 transmits signals in response to starting of the prime mover PM.

The operation is as follows:

The cigarette maker of FIG. 1 is automated so that various components thereof are started or arrested in a predetermined sequence in order to avoid waste of tobacco and/or the production of defective cigarettes 121. Thus, when the prime mover PM of the cigarette maker is started, the customary roller-shaped or nozzle-like applicator of the paster 18 is moved to engage the upstanding marginal portion of the web 12 with a certain delay following starting of the distributor 5 to thereby insure that the web which has been converted into a tubular wrapper during travel through the wrapping mechanism 17 surrounds a satisfactory filler 9. Reference may be had to commonly owned U.S. Pat. Nos. 3,672,373 and 3,874,391 respectively granted June 27, 1972 and April 1, 1975 to Dögl et al. which describe a fully automated cigarette maker. The movement of applicator of the paster 18 into engagement with the upstanding marginal portion of the web 12 (i.e., actuation of the paster) results in transmission of a signal to the input b of the AND-gate 43 whose input a receives signals from the proximity switch 46 at a frequency which is indicative of the speed of the prime mover PM. Therefore, the output c of the AND-gate 43 (this gate can be said to constitute a means for monitoring the condition of the paster 18) transmits signals to the input a of the counter 41 at the frequency of pulse generation by the proximity switch 46, i.e., the pulse generator monitors the speed of the prime mover and hence the speed of the rod 21. The counter 41 compares the number of signals with a predetermined number which is selected by the adjustable decoding unit 42 (such predetermined number is indicative of the distance between the paster 18 and the first plate 26). The output d of the counter 41 transmits a signal to the input a of the signal storing unit 39 as soon as the number of signals received from the AND-gate 43 matches the predetermined number. The output c of the storing unit 39 then transmits a continuous signal to the amplifier 38 which energizes the solenoid 36*a* so that the valve 36 admits compressed gas into the chamber B of the cylinder 28 and connects the chamber A with the atmosphere. The piston rod 30 moves the plate 26 downwardly and into engagement with the seam 121B of the wrapper of the moving cigarette rod 21.

The detector 57 transmits a signal to the input a of the AND-gate 56 as soon as the plate 26 engages the seam 121B. The input b of the AND-gate 56 receives signals from the proximity switch 46 so that the output c of this gate begins to transmit signals to the input of the digital-to-analog converter 54. The voltage signal at the ouput of the converter 54 is indicative of the speed of the prime mover PM, and such signal is transmitted to the corresponding input of the signal comparing stage 51 via resistor means 53. The stage 51 compares such signal with the reference signal furnished by the potentiometer 52 and transmits a signal to the switch 49 as soon as the speed of the prime mover PM matches the predetermined speed denoted by the reference signal. The output of the switch 49 transmits a signal to the input a of the signal storing unit 48 whose output c causes the amplifier 47 to energize the solenoid 37*a*. The valve 37 then admits compressed gas into the chamber BB and connects the chamber AA with the atmosphere; therefore, the piston rod 35 moves downwardly and causes the plate 27 to engage the seam 121B of the wrapper of the moving cigarette rod 21.

The means for heating the plates 26, 27 is of conventional design. Such means may include one or more electric resistance heaters or means for circulating a heating fluid. As stated above, the heating action of the plate 27 is preferably more pronounced than that of the plate 26; for example, the heating action of the plate 27 may be twice the heating action of the plate 26.

The plates 26 and 27 should be disengaged from the seam 121B as soon as the prime mover PM of the cigarette maker is deactivated. Such deactivation entails a deactivation of the paster 18, i.e., the applicator of the paster 18 is disengaged from the upstanding marginal portion of the web 12. The moving parts of the cigarette maker continue to move due to inertia so that the input a of the AND-gate 62 continues to receive signals from the proximity switch 46 while the input b of this gate receives a signal from the paster 18 (in response to stoppage of the prime mover PM). The output c of the AND-gate 62 transmits signals to the input a of the counter 59 whose input b receives a signal from the decoding unit 61. The signal from the unit 61 denotes a predetermined number of signals, namely, that number which the pulse generator transmits during movement of an increment of the web 12 from the paster 18 to the plate 26. The output d of the counter 59 transmits a signal to the erasing inputs b of the signal storing units 39 and 48 when the number of signals received at the input a of the counter 59 matches the preselected number. The signals at the outputs c of the storing units 39 and 48 disappear and the solenoids 36*a*, 37*a* are deenergized so that the valving elements of the valves 36 and 37 return to the illustrated positions (see the springs 36*b* and 37*b*). Thus, the chambers B and BB communicate with the atmosphere and the chambers A and AA receive compressed gas. The plates 26 and 27 are lifted above and away from the seam 121B of the cigarette rod 21.

The aforedescribed operation of the heating device 19 shown in FIG. 2 is resumed when the prime mover PM is started again. Such starting results in transmission of a signal via conductor means 70 so that the counter 59 is reset to zero and the signal at the output c of the storing unit 58 disappears, i.e., the outputs c of the storing units 39 and 48 transmit signals again as soon as their inputs a respectively receive signals from the output d of the counter 41 and from the output b of the switch 49.

It is clear that the double-acting pneumatic cylinder and piston units which reciprocate the plates 26, 27 constitute but one form of motor means which can move the plates into and from engagement with the seam of the wrapper of the cigarette rod. For example, the plate 26 and/or 27 can be moved by electric motor means through the medium of rack and pinion drives or the like.

Furthermore, the improved heating device may include three or even more discrete heating elements which are located one behind the other, as considered in the direction of movement of the rod 21, and are caused to engage the seam 121B one after the other. For example, the first heating element will engage the seam when the rod 21 is accelerated from zero speed to a first speed, the second heating element will engage the seam when the rod is accelerated to a second speed which is still less than the normal operating speed, and a third heating element will be caused to descend and to engage the seam when the speed of lengthwise movement of the rod reaches or already closely approximates the normal operating speed. Such construction of the heating device 19 would necessitate the provision of additional moving means for the third heating element (and, if necessary, moving means for one or more additional heating elements).

It is further clear that the improved heating device can be incorporated in or combined with other types of machines for the production of rod-shaped articles which constitute or form part of smokers' products. Such other types include machines for the production of plain cigarillos or cigars, filter rod making machines and/or others.

As a rule, the adhesive which must be heated to promote its setting is a so-called wet adhesive.

An important advantage of the improved device is that the seam of the wrapper is not likely to be charred or discolored during starting of the machine, i.e., while the prime mover drives the moving parts at less than normal operating speed. The device of my invention insures that the heat energy input is properly related to the speed of the seam, i.e., that the seam is adequately heated to insure setting of the adhesive film between the overlapping marginal portions but that the marginal portions and/or the wrapper portions adjacent thereto are not defaced, damaged or destroyed. Moreover, the heating device of the present invention is capable of reacting at the requisite speed so as to insure that the heating action which is applied to the seam is invariably within the optimum range even if the acceleration of the machines from zero speed to normal operating speed takes up a very short interval of time. Thus, the second plate 27 is caused to engage or to move into immediate proximity of the seam 121B as soon as the prime mover PM begins to drive the moving parts at the normal operating speed regardless of the length of such interval of acceleration. As a rule, the interval of acceleration to normal operating speed is very short. It has been found that the improved device insures adequate setting of adhesive immediately after starting as well as during normal operation of the machine. This, in turn, insures that the heating device does not contribute to the production of defective articles during those stages of operation when the machine runs at less than normal speed and/or immediately after the machine begins to run at normal speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a machine for the making of wrapped rod-like fillers of tobacco and/or filter material wherein a web of wrapping material is draped around the filler so that the marginal portions of the web overlap each other, the combination of means for transporting the filler and the web at a variable speed lengthwise in a predetermined direction along a predetermined path; paster means operable to apply adhesive to at least one marginal portion of the web in a first portion of said path; means for folding the marginal portions of the web over each other in a second portion of said path downstream of said first portion, as considered in said direction, to thus convert the web into a tubular wrapper which surrounds the filler and wherein the marginal portions and the adhesive form a seam extending lengthwise of the resulting wrapper; adjustable means for heating the adhesive of said seam in a third portion of said path downstream of said second portion, including first and second seam heating elements located one behind the other, as considered in said direction, said elements being movable into and from engagement with successive increments of the seam in said third portion of said path; means for adjusting said heating means stepwise as a function of changes in the speed of said filler so that the seam is subjected to a less pronounced heating action at a lower speed and to a more pronounced heating action at a higher speed of the filler, including discrete first and second moving means for said first and second seam heating elements, means for monitoring the speed of the filter, first operating means for operating said first moving means during and subsequent to acceleration of the filler to a predetermined speed so as to move said first element into engagement with the seam, and second operating means for operating said second moving means on acceleration of said filler to said predetermined speed so as to move said second element into engagement with the seam; and variable-speed prime mover means, said second operating means including means for monitoring the speed of said prime mover means and for initiating the operation of said second moving means when said variable-speed prime mover means completes the acceleration of the filler to said predetermined speed.

2. The combination of claim 1, wherein one of said heating elements includes means for furnishing a heating action whose intensity exceeds the intensity of heating action of the other of element.

3. The combination of claim 1, wherein at least one of said moving means includes a fluid-operated motor.

4. In a machine for the making of wrapped rod-like fillers of tobacco and/or filter material wherein a web of wrapping material is draped around the filler so that the marginal portions of the web overlap each other, the combination of means for transporting the filler and the web at a variable speed lengthwise in a predetermined direction along a predetermined path; paster means operable to apply adhesive to at least one marginal portion of the web in a first portion of said path; means for actuating said paster means; means for folding the marginal portions of the web over each other in a second portion of said path downstream of said first portion, as considered in said direction, to thus convert the web into a tubular wrapper which surrounds the filler and wherein the marginal portions and the adhesive form a seam extending lengthwise of the resulting wrapper; adjustable means for heating the adhesive of said seam in a third portion of said path downstream of said second portion, said heating means including first and second heating elements located one behind the other, as considered in said direction, and said elements being movable into and from engagement with successive increments of the seam in said third portion of said path; and means for adjusting said heating means stepwise as a function of changes in the speed of said filler so that the seam is subjected to a less pronounced heating action at a lower speed and to a more pronounced heating action at a higher speed of the filler, said adjusting means including discrete first and second moving means for said first and second elements, means for monitoring the speed of the filler, means for operating said first moving means during and subsequent to acceleration of the filler to a predetermined speed so as to move said first element into engagement with the seam, means for operating said second moving means on acceleration of said filler to said predetermined speed so as to move said second element into engagement with the seam, and means for starting said operating means for said first heating element with a predetermined delay following the actuation of said paster means so that the foremost adhesive-coated increment of said one marginal portion is in register with said first element when the latter engages the seam.

5. The combination of claim 4, wherein said means for starting said operating means for said first heating element with said predetermined delay comprises means for monitoring the condition of said paster means.

* * * * *